US007811020B2

(12) United States Patent
Chen et al.

(10) Patent No.: US 7,811,020 B2
(45) Date of Patent: Oct. 12, 2010

(54) WRITING INSTRUMENT

(75) Inventors: Yu-Gang Chen, Tainan County (TW); Jung-Kuang Chen, Tainan County (TW)

(73) Assignee: Far East University, Tainan County (TW)

( * ) Notice: Subject to any disclaimer, the term of this patent is extended or adjusted under 35 U.S.C. 154(b) by 0 days.

(21) Appl. No.: 12/651,869

(22) Filed: Jan. 4, 2010

(65) Prior Publication Data

US 2010/0104351 A1 Apr. 29, 2010

Related U.S. Application Data

(63) Continuation-in-part of application No. 11/534,592, filed on Sep. 22, 2006, now abandoned.

(51) Int. Cl.
*B43K 29/00* (2006.01)

(52) U.S. Cl. ..... 401/195

(58) Field of Classification Search ..... 401/195
See application file for complete search history.

(56) References Cited

U.S. PATENT DOCUMENTS 256,738 A * 4/1882 Reckendorfer et al. .. 116/137 R
4,371,278 A * 2/1983 Joo ..... 401/195
5,826,998 A * 10/1998 Shih ..... 401/52
5,967,686 A * 10/1999 Melnick ..... 401/195

* cited by examiner

*Primary Examiner*—David J Walczak
(74) *Attorney, Agent, or Firm*—WPAT, P.C.; Anthony King

(57) ABSTRACT

The writing instrument comprises a first hollow tube body, a second hollow tube body and a refill. The first hollow tube body comprises a passing hole. The second hollow tube body comprises a protrusion end to correspondingly, tightly fit with the first hollow tube body, and an air inlet at the other end. The first hollow tube body comprises scale holes, at least two semitone holes near the passing hole, first air outlets, the first air outlets being between the two semitone holes. The second hollow tube body further comprises a second air outlet. Via combination of the first hollow tube body and the second hollow tube body, different tones are generated by covering the scale holes and the semitone holes. The refill can be disposed into the writing instrument, and a nib of the refill can protrude outside of the writing instrument from the passing hole.

4 Claims, 4 Drawing Sheets

WRITING INSTRUMENT

CROSS-REFERENCE TO RELATED APPLICATIONS

This application claims priority to, and is a Continuation-in-part of, U.S. patent application Ser. No. 11/534,592, filed on Sep. 22, 2006, now abandoned, which claims foreign priority to Taiwan application No. 095210513, filed Jun. 16, 2006, which are hereby incorporated by reference in their entirety.

Although incorporated by reference in its entirety, no arguments or disclaimers made in the parent application apply to this divisional application. Any disclaimer that may have occurred during the prosecution of the above-referenced application(s) is hereby expressly rescinded. Consequently, the Patent Office is asked to review the new set of claims in view of all of the prior art of record and any search that the Office deems appropriate.

FIELD OF THE INVENTION

The present invention relates to a writing instrument, and more particularly to a writing instrument that provides entertainments and increases competition abilities.

BACKGROUND OF THE INVENTION

Writing instruments are used for works or studies. Recently, some stationers would add some toys or ornaments on the writing instruments to improve beauties and functions, thereby catching users' attention.

The writing instruments which have the functions or ornaments are variety, including quill pens and laser pens. However, these writing instruments are unable to catch the users' attention due to simple ornaments. Without the users' attention, the writing instruments are thrown away. Alternatively, after the ink of refills is used up, entire writing instruments are then thrown away to cause unnecessary wastage. Moreover, some writing instruments may be played by the users to generate a single monosyllable that is unable to satisfy the users regarding the pursuit of syllable variations. The competition abilities of these writing instruments are then decreased.

The inventor of the present invention based on years of experience to conduct extensive researches and experiments on conventional writing instruments invents a writing instrument, as a method or a basis for achieving the aforementioned object. A complete music is then formed when a user plays the writing instrument.

SUMMARY OF THE INVENTION

Accordingly, an object of the present invention is to provide a writing instrument to improve the entertainment of the writing instrument. The value added and competition of the writing instrument are also increased.

To achieve the foregoing object, the writing instrument comprises a first hollow tube body, a second hollow tube body and a refill. The first hollow tube body comprises a passing hole at the other end. The second hollow tube body comprises a protrusion end which is to correspondingly, tightly fit with the first hollow tube body, and an air inlet at the other end. The first hollow tube body comprises a plurality of scale holes arranged uniformly at its surface, at least two semitone holes near the passing hole, a plurality of first air outlets located around the first hollow tube body, the first air outlets being located between the two semitone holes and close to the passing hole 130 of the first hollow tube body 11. The second hollow tube body comprises a second air outlet near the aforesaid air inlet.

According to the corresponding protrusion end of the second hollow tube body, the first hollow tube body and the second hollow tube body can lock together to be an integrated grasp body design. The grasp body is a hollow main body. Therefore, via combination of the first hollow tube body and the second hollow tube body, air is injected from the air inlet, such that some of the air is ejected to the outside of the second hollow tube body from the second air outlet and the rest of the air is guided to pass from the second hollow tube body to the first hollow tube body then passes from the first air outlets to outside of the first hollow tube body. Therefore different tones are generated by covering the scale holes and the semitone holes. The actual practice method is to inject air into the air inlet via a user's mouth and covering the scale holes and the semitone holes through the user's fingers. Therefore, the musical tones are generated simultaneously. Otherwise, the residual air is removal from the first air outlet and the second air outlet to outside of the grasp body.

The aforementioned refill can be disposed into the grasp body, while the first hollow tube body separates from the second hollow tube body. Consequently, a nib of the refill can protrude outside of the grasp body from the passing hole. Finally, the second hollow tube body locks with the first hollow tube body via the protrusion design, the refill accommodates in the hollow space of the grasp body. Therefore, the refill can be assembled into the grasp body or replaced from the grasp body.

It is concluded that the hollow space of the grasp body accommodates not only the refill to make the present invention be a writing ball-point-pen and pencil, but also the air injected from the air inlet to make the present invention be a musical instrument, such like clarinet and flute.

Other features and advantages of the present invention and variations thereof will become apparent from the following description, drawings, and claims.

DETAILED DESCRIPTION OF THE PREFERRED EMBODIMENTS

Figure 1:
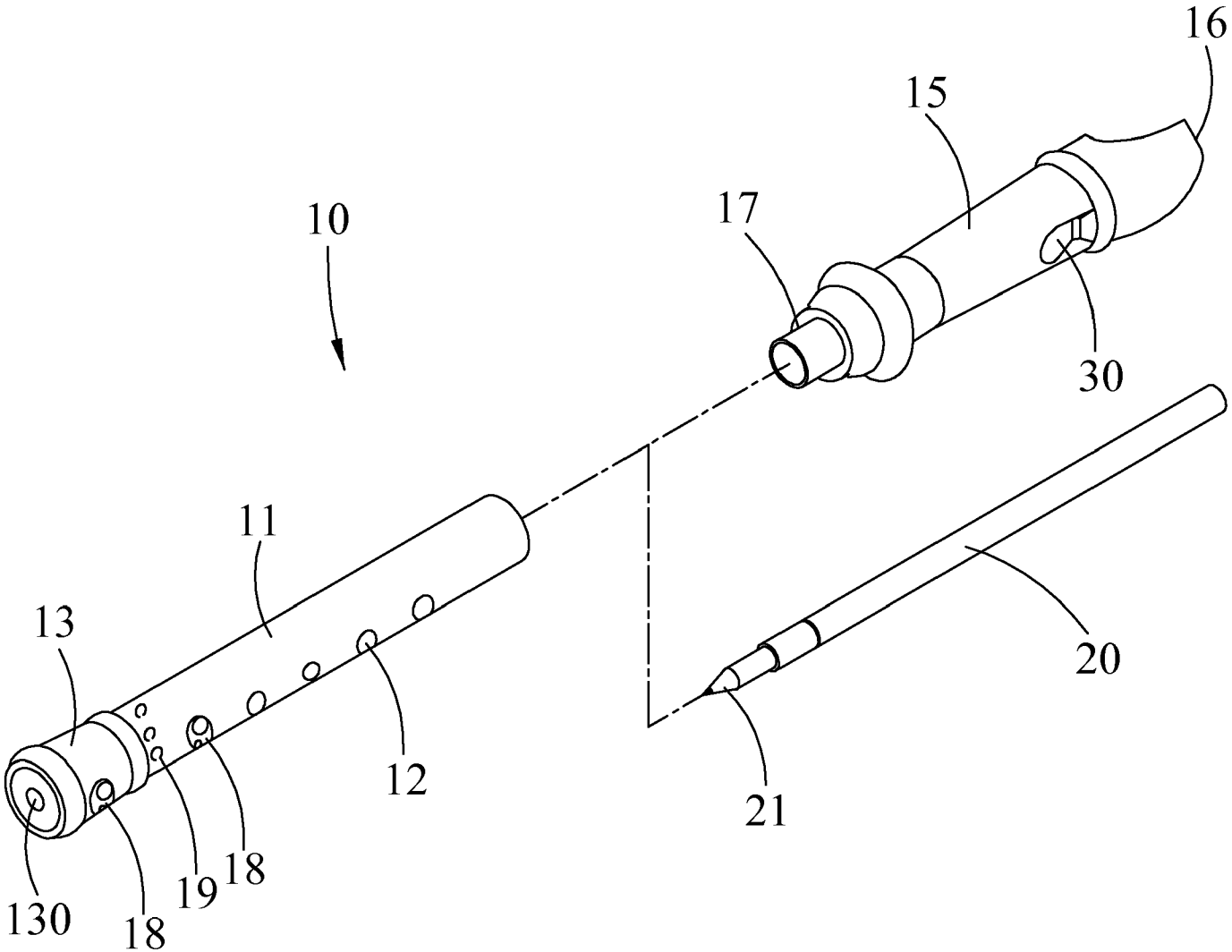
FIG. 1 is a perspective drawing for the writing instrument according to the present invention.
Figure 2:
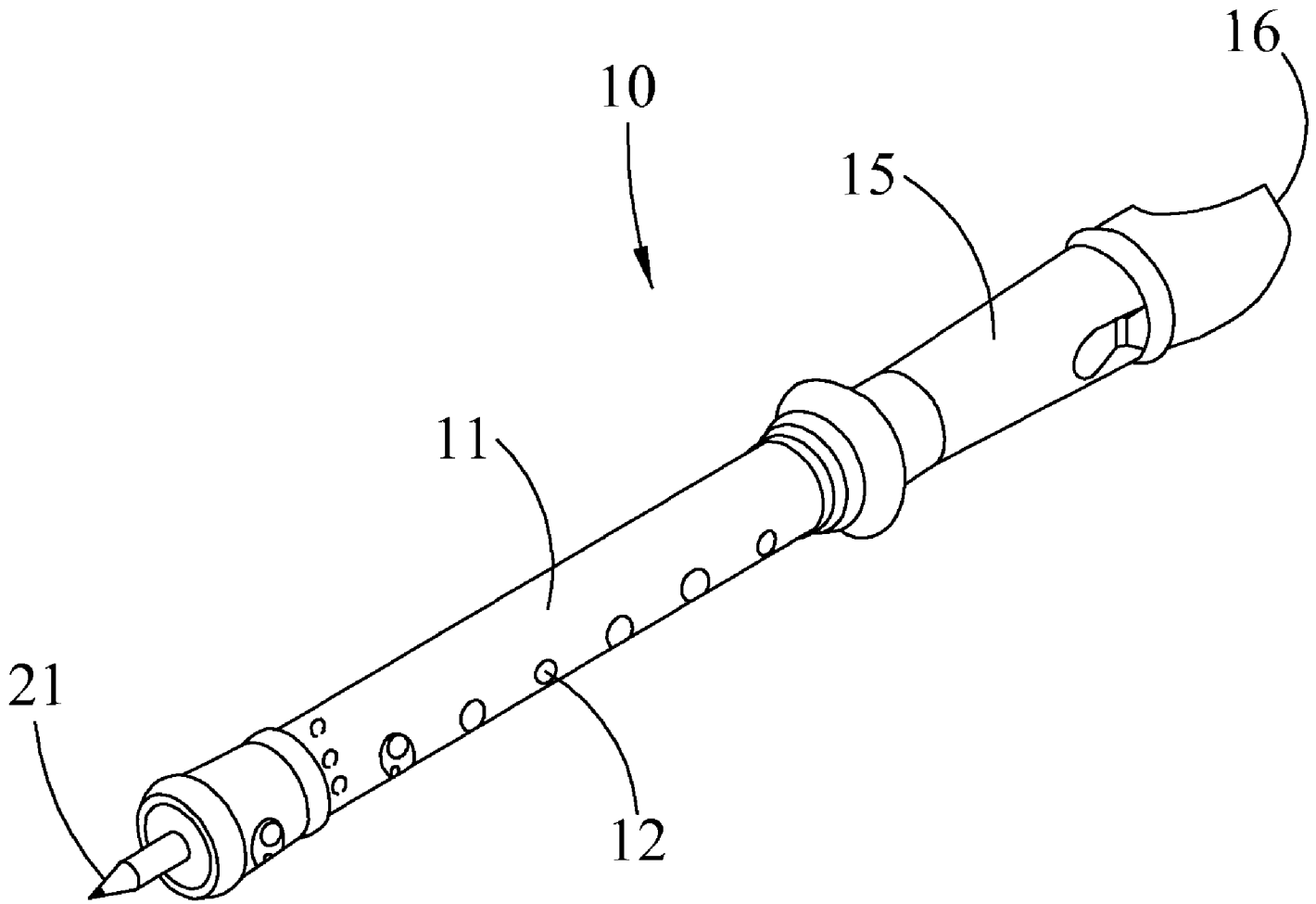
FIG. 2 is a perspective drawing for the writing instrument according to the present invention.

Refer first to FIG. 1 and FIG. 2, wherein two perspective drawings of the writing instrument according to the present invention are shown. The writing instrument comprises a first hollow tube body 11, a second hollow tube body 15 and a refill 20. The first hollow tube body 11 comprises a passing hole 130 at the one end. The second hollow tube body 15 comprises a protrusion end 17 which is to correspondingly, tightly fit with the first hollow tube body 11, and an air inlet 16 at the other end. The first hollow tube body 11 comprises a plurality of scale holes 12 arranged uniformly at its surface, at least two semitone holes 18 near the passing hole 130, a plurality of first air outlets 19 located around the first hollow tube body 11, the first air outlets 19 being located between the two semitone holes 18 and close to the passing hole 130 of the first hollow tube body 11. The second hollow tube body 15 comprises a second air outlet 30 near the aforesaid air inlet 16.

According to the corresponding protrusion end 17 of the second hollow tube body 15, the first hollow tube body 11 and the second hollow tube body 15 can lock together to be an integrated grasp body 10. The grasp body 10 is a hollow main body. Therefore, via combination of the first hollow tube body 11 and the second hollow tube body 15, air is injected from the air inlet 16, such that some of the air is ejected to the outside of the second hollow tube body 15 from the second air outlet 30 and the rest of the air is guided to pass from the second hollow tube body 15 to the first hollow tube body 11 then ejects from the first air outlets 19 to outside of the first hollow tube body 11. Therefore different tones are generated by covering the scale holes 12 and the semitone holes 18. The actual practice method is to inject air into the air inlet 16 via a user's mouth and covering the scale holes 12 and the semitone holes 18 through the user's fingers, therefore the musical tones are generated simultaneously. Otherwise, the residual air is removal from the first air outlets 19 and the second air outlet 30 to outside of the grasp body 10.

The aforementioned refill 20 can be disposed into the grasp body 10, while the first hollow tube body 11 separates from the second hollow tube body 15. Consequently, a nib 21 of the refill 20 can protrude outside of the grasp body 10 from the passing hole 130, as shown in FIG. 2. Finally, the second hollow tube body 15 locks with the first hollow tube body 11 via the protrusion design, the refill 20 accommodates in the hollow space of the grasp body 10. Therefore, the refill 20 can be assembled into the grasp body 10 or replaced from the grasp body 10.

It is concluded that the hollow space of the grasp body 10 accommodates not only the refill 20 to make the present invention be a writing ball-point-pen and pencil, but also the air injected from the air inlet 16 to make the present invention be a musical instrument, such like clarinet and flute.

In other words, the user can use his/her mouth that corresponds to the air inlet 16 of the second hollow tube body 15 for blowing. The user uses fingers to press the scale holes 12 of the first hollow tube body 11 synchronously. The writing instrument with the writing and the blowing functions is thus provided.

Figure 3:
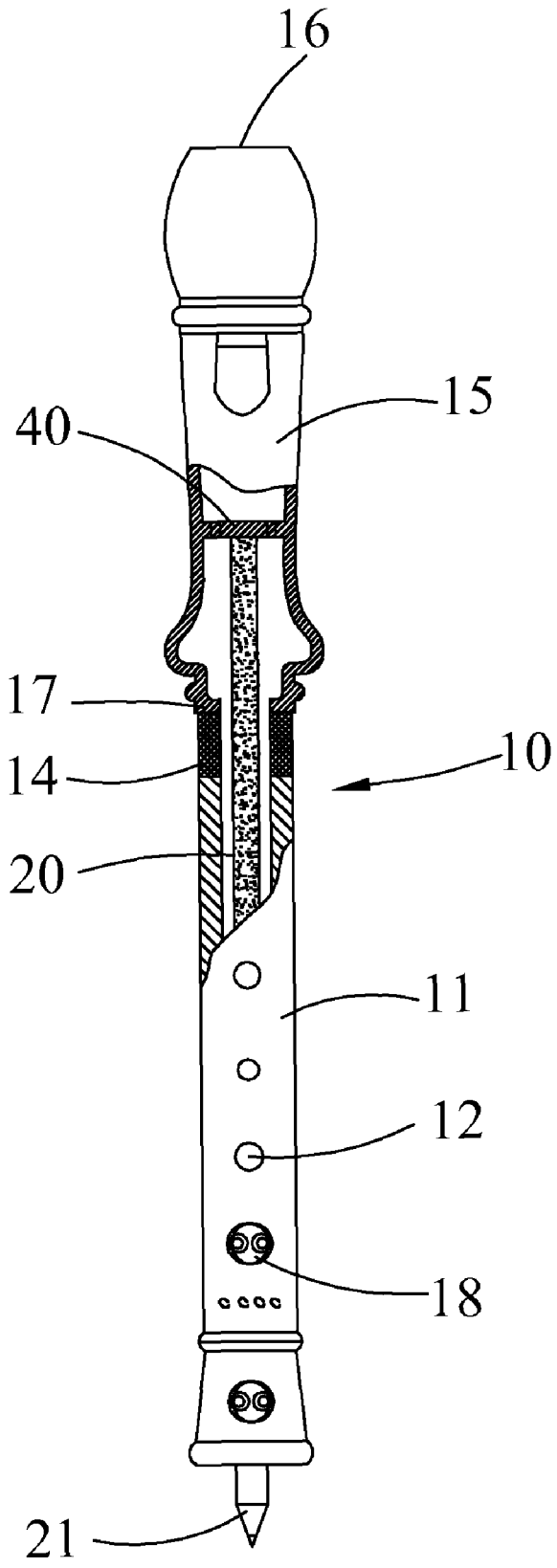
FIG. 3 is a partial cross-sectional view for the writing instrument according to the present invention.

Refer then to FIG. 3, wherein a partial cross-sectional view for the writing instrument according to the present invention is shown. The writing instrument further comprises a block slice 40 located inside the second hollow tube body 15. Therefore, the top of the refill 20 can be against a bottom of the block slice 40 to keep the stability of the refill 20 while writing. The user does not only use the refill 20 to use the nib 21 for writing after protruding from the passing hole of first hollow tube body, but also uses the mouth to blow the air inlet 16 of the second hollow tube body 15. Different tonalities are generated by covering the scale holes 12 and the semitone holes 18 to perform music like an instrument. The entertainment is then increased to improve the competition ability of products further.

Figure 4:
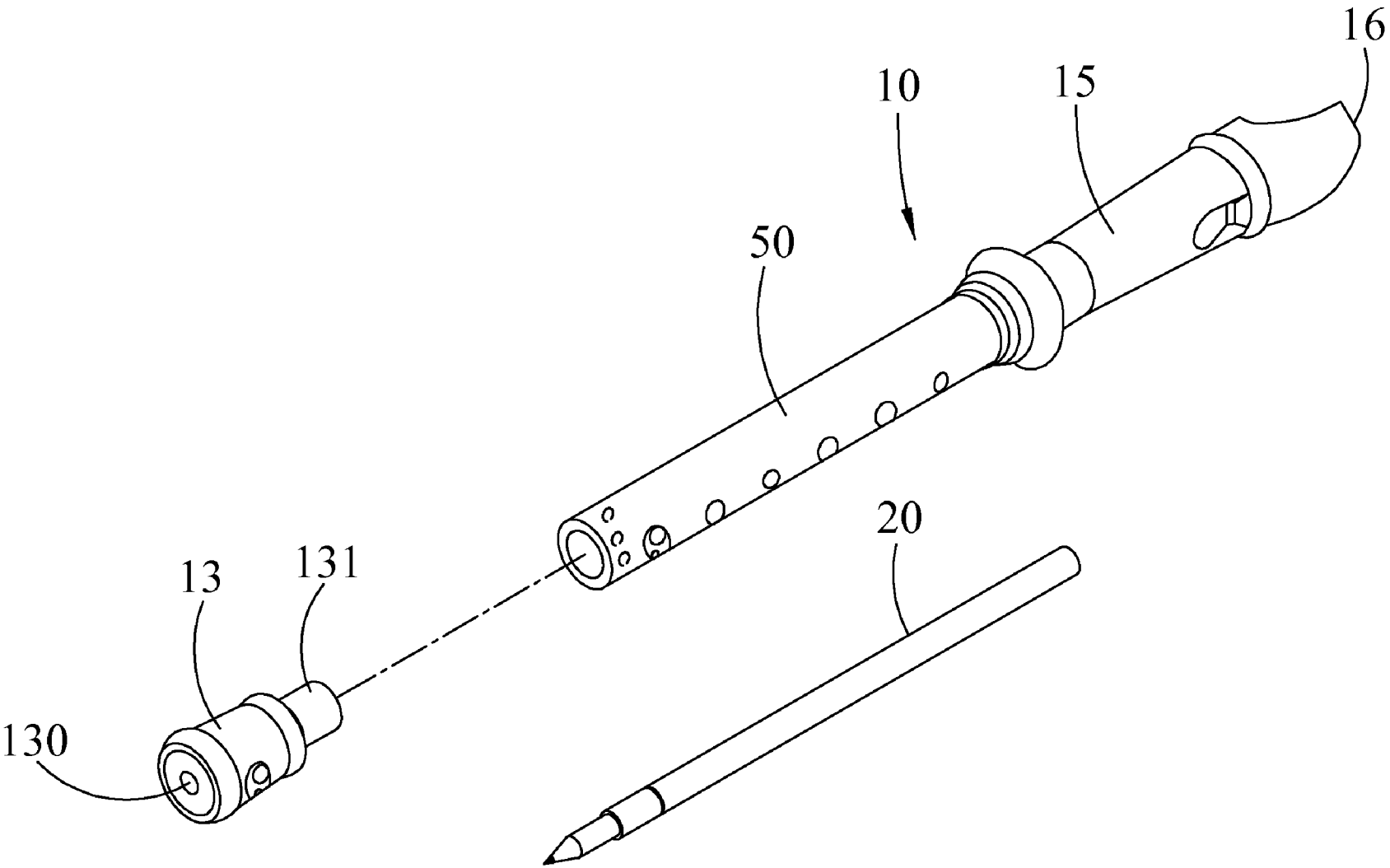
FIG. 4 is an exploded drawing for the writing instrument according to the present invention.

Refer first to FIG. 4, wherein an exploded drawing for the writing instrument according to the present invention is shown. The first hollow tube body 11 also divides into two parts, as an hollow portion end 13 and a third hollow tube body 50, and these two parts are combined is the same manner as the combination of the first hollow tube body 11 and the second hollow tube body 15. The hollow portion end 13 of the first hollow tube body 11 comprises a hollow protrusion 131 at its one end, and the third tube body 50 of the first hollow tube body 11 comprises a corresponding part at its one end which is corresponding to the hollow protrusion 131 of the hollow portion end 13. According to the corresponding part of the third tube body 50 and the hollow protrusion 131 of the hollow portion end 13, the third tube body 50 and the hollow portion end 13 can lock together to be an integrated first hollow tube body 11.

Although the features and advantages of the embodiments according to the preferred invention are disclosed, it is not limited to the embodiments described above, but encompasses any and all modifications and changes within the spirit and scope of the following claims.

What is claimed is:

1. A writing instrument, comprising:

a grasp body being a hollow main body, comprising:

a first hollow tube body having a passing hole at one end, a plurality of scale holes arranged uniformly at a surface of the first hollow tube body, at least two semitone holes near the passing hole and a plurality of first air outlets located around the first hollow tube body; and a second hollow tube body having a protrusion end which tightly fits with a corresponding part of the first hollow tube body, an air inlet at the other end, and a second air outlet; and a refill disposed into the grasp body, and a nib of the refill being protruding outside of the grasp body from the passing hole, wherein the first hollow tube body is attachable and detachable from the corresponding protrusion end of the second hollow tube body, wherein air is injected from the air inlet, such that some of the air is ejected to the outside of the second hollow tube body from the second air outlet and the rest of the air is guided to pass from the second hollow tube body to the first hollow tube body and then ejects from the first air outlets to outside of the first hollow tube body such that different tones are generated by covering the scale holes and the semitone holes.

2. The writing instrument of claim 1, wherein the first air outlets are located close to the passing hole of the first hollow tube body.

3. The writing instrument of claim 1, wherein the first hollow tube body further comprises at least two semitone holes located near the passing hole.

4. The writing instrument of claim 1, wherein the grasp body is a clarinet or flute.

* * * * *